US008558483B2

(12) United States Patent
Lee et al.

(10) Patent No.: US 8,558,483 B2
(45) Date of Patent: Oct. 15, 2013

(54) NON-LINEAR LOAD DRIVING CIRCUIT AND CONTROLLER

(75) Inventors: Li-Min Lee, New Taipei (TW); Shian-Sung Shiu, New Taipei (TW); Chung-Che Yu, New Taipei (TW); Xi Tu, Wuxi (CN)

(73) Assignee: Green Solution Technology Co., Ltd., New Taipei (TW)

( * ) Notice: Subject to any disclaimer, the term of this patent is extended or adjusted under 35 U.S.C. 154(b) by 259 days.

(21) Appl. No.: 13/118,557

(22) Filed: May 30, 2011

(65) Prior Publication Data

US 2012/0104967 A1 May 3, 2012

(30) Foreign Application Priority Data

Oct. 27, 2010 (CN) ..... 2010 1 0527507

(51) Int. Cl.
*H05B 37/02* (2006.01)

(52) U.S. Cl.
USPC ..... 315/307; 315/185 R; 315/224; 315/291; 315/209 R

(58) Field of Classification Search
USPC ..... 315/129, 130, 185 R, 209 R, 247, 224, 315/276, 291, 307; 327/172, 581
See application file for complete search history.

(56) References Cited

U.S. PATENT DOCUMENTS 6,285,139 B1 * 9/2001 Ghanem ..... 315/291
6,400,102 B1 * 6/2002 Ghanem ..... 315/291
6,734,639 B2 5/2004 Chang et al.
7,023,713 B2 4/2006 Liao
7,274,177 B2 9/2007 Huang et al.
7,733,030 B2 * 6/2010 Brokaw et al. ..... 315/209 R
2009/0167200 A1 * 7/2009 Brokaw et al. ..... 315/224

FOREIGN PATENT DOCUMENTS

TW 200731666 8/2007
TW 201006109 2/2010

OTHER PUBLICATIONS

"Office Action of Taiwan Counterpart Application", issued on May 22, 2013, p. 1-p. 5, in which the listed references were cited.

* cited by examiner

*Primary Examiner* — Vibol Tan
(74) *Attorney, Agent, or Firm* — Jianq Chyun IP Office

(57) ABSTRACT

A non-linear load driving circuit and a controller for controlling a conversion circuit to drive a non-linear load are provided. The controller includes a feedback unit, a pulse width control unit, and an overshoot reduction unit. The feedback unit generates a feedback signal according to a current feedback signal that represents a load current flowing through the non-linear load. The pulse width control unit generates a control signal according to the feedback signal to control a power output of the conversion circuit. The overshoot reduction unit generates an overshoot reduction signal when the load current changes from being smaller than to being greater than a predetermined value according to the current feedback signal. The pulse width control unit receives the overshoot reduction signal and reduces the duty cycle of the control signal accordingly. Thereby, stability of feedback control is improved and damage to circuit is prevented.

12 Claims, 5 Drawing Sheets

NON-LINEAR LOAD DRIVING CIRCUIT AND CONTROLLER

CROSS-REFERENCE TO RELATED APPLICATION

This application claims the priority benefit of China application serial no. 201010527507.4, filed on Oct. 27, 2010. The entirety of the above-mentioned patent application is hereby incorporated by reference herein and made a part of this specification.

BACKGROUND OF THE INVENTION

1. Field of the Invention

The present invention generally relates to a non-linear load driving circuit and a controller, and more particularly, to a non-linear load driving circuit capable of reducing overshoot and a controller.

2. Description of Related Art

FIG. 1 is a diagram of a conventional light emitting diode (LED) driving circuit. Referring to FIG. 1, the LED driving circuit includes a controller 10, a conversion circuit 50, and an LED module 60. The conversion circuit 50 is coupled to an input voltage source Vin. The controller 10 generates a control signal Sc to control the conversion circuit 50 to transmit a power from the input voltage source Vin to an output terminal. The output terminal of the conversion circuit 50 is coupled to the LED module 60 to apply an output voltage Vout on the LED module 60, so as to make an output current Iout to flow through the LED module 60 and make the LED module 60 thus to emit light. The output current Iout also flows through a current detection resistor 65 to generate a current feedback signal IFB.

The controller 10 includes an error amplifier 12, a triangular wave generator 14, a pulse width modulation (PWM) comparator 16, and a driving circuit 18. The error amplifier 12 receives the current feedback signal IFB and a reference voltage Vr and generates an error amplified signal Vea according to the current feedback signal IFB and the reference voltage Vr. The triangular wave generator 14 generates a triangular wave signal for the PWM comparator 16. The PWM comparator 16 also receives the error amplified signal Vea and generates a PWM signal for the driving circuit 18 according to the comparison of the error amplified signal Vea and the triangular wave signal. The driving circuit 18 generates the control signal Sc according to the PWM signal generated by the PWM comparator 16.

Generally speaking, the controller 10 stabilizes the output current Iout at a predetermined output current Io. In this case, the output voltage Vout is also stabilized at a predetermined output voltage Vo. However, the error amplifier 12 compares the current feedback signal IFB with the reference voltage Vr and integrates the error between foregoing two signals to adjust the level of the error amplified signal Vea. Such a feedback control process causes the output current Tout and the output voltage Vout to oscillate around and gradually converge towards the predetermined output current Io and the predetermined output voltage Vo (i.e., the amplitudes thereof decrease).

FIG. 2 illustrates waveforms of signals in the LED driving circuit in FIG. 1 during a startup process of the LED driving circuit. Before the controller 10 is started, the output voltage Vout, the output current Tout, the error amplified signal Vea, and the control signal Sc are all at low levels. When the controller 10 is started at the time point T0, since the output current Tout is much lower than the predetermined output current Io, the error amplified signal Vea increases quickly, and accordingly the duty cycle of the control signal Sc also increases quickly. Herein the output voltage Vout also starts to increase. Before the output voltage Vout reaches the threshold voltage Vf of the LED module 60 (i.e., before the time point T1), the output current Tout flowing through the LED module 60 remains at the zero level. Because the output current Tout remains much lower than the predetermined output current Io during the period T0-T1, the error amplified signal Vea increases to its highest level. The output current Iout starts to increase at time point T1 and reaches the predetermined output current Io at time point T2.

At the time point T2, the output current Tout is higher than the predetermined output current Io, so that the error amplifier 12 starts to pull down the level of the error amplified signal Vea. However, due to the integration, the error amplified signal Vea cannot drop to an error steady value Veao (i.e., the level of the error amplified signal Vea corresponding to the output current Iout when the output current Tout is stabilized at the predetermined output current Io) directly. As a result, the duty cycle of the control signal Sc is too large, so that the output current Tout continues to increase until the error amplified signal Vea is lower than the error steady value Veao and then the duty cycle of the control signal Sc is too small. At the time point T3, the output current Tout is lower than the predetermined output current Io again. Then, the error amplified signal Vea increases again and exceeds the error steady value Veao. Foregoing process continues until time point T4, at which the output current Tout, the output voltage Vout, and the error amplified signal Vea respectively converge to the corresponding predetermined output current Io, predetermined output voltage Vo, and error steady value Veao.

Besides during the startup process of the controller 10, overshoot of output current is also produced when the LED module performs burst dimming. Moreover, when the output current Iout reaches the predetermined output current Io for the first time, the error amplified signal Vea remains at the highest level, so that very large overshoots are produced in the output current Iout and output voltage Vout. The overlarge current and voltage overshoots reduce the stability of the circuit and may even damage the circuit.

SUMMARY OF THE INVENTION

In the conventional technique, large current and voltage overshoots reduce the stability of feedback control and may even damage a circuit. Accordingly, the invention provides an overshoot reduction mechanism regarding the feedback control of a non-linear load (for example, a light emitting diode (LED)), so as to reduce overshoots in the output current and output voltage and resolve aforementioned problem in the conventional technique.

The invention provides a controller for controlling a conversion circuit to drive a non-linear load. The controller includes a feedback unit, a pulse width control unit, and an overshoot reduction unit. The feedback unit generates a feedback signal according to a current feedback signal, wherein the current feedback signal represents a load current flowing through the non-linear load. The pulse width control unit generates a control signal according to the feedback signal to control a power output of the conversion circuit. The overshoot reduction unit determines whether the load current changes from being smaller than a predetermined value to being greater than the predetermined value according to the current feedback signal and generates an overshoot reduction signal when the load current changes from being smaller than the predetermined value to being greater than the predetermined value. The pulse width control unit receives the overshoot reduction signal and reduces the duty cycle of the control signal according to the overshoot reduction signal.

The invention provides a controller for controlling a conversion circuit to drive a non-linear load. The controller includes a feedback unit, a pulse width control unit, and an overshoot reduction unit. The feedback unit generates a feedback signal according to a current feedback signal, wherein the current feedback signal represents a load current flowing through the non-linear load. The pulse width control unit generates a control signal according to the feedback signal to control a power output of the conversion circuit. The overshoot reduction unit generates an overshoot reduction signal according to a voltage feedback signal, wherein the voltage feedback signal represents a load voltage applied to the non-linear load. The pulse width control unit receives the overshoot reduction signal and reduces the duty cycle of the control signal according to the overshoot reduction signal.

The invention provides a non-linear load driving circuit for driving a non-linear load. The non-linear load driving circuit includes a conversion circuit and a controller. The conversion circuit couples an input voltage source and the non-linear load, converts a power received from the input voltage source, and drives the non-linear load by using the converted power. The controller generates at least one control signal according to a current feedback signal to control the conversion circuit to convert the power, wherein the current feedback signal represents a load current flowing through the non-linear load. The controller reduces the duty cycle of the control signal when the load current flowing through the non-linear load changes from being smaller than a predetermined current to being greater than the predetermined current or a load voltage applied to the non-linear load changes from being smaller than a predetermined voltage to being greater than the predetermined voltage.

As described above, in the invention, the voltage or current on a non-linear load is detected, and the duty cycle of a control signal of a controller is reduced when the voltage or current reaches a preset value, so that the transmission of power from an input voltage source is slowed down and accordingly overshoot is reduced.

These and other exemplary embodiments, features, aspects, and advantages of the invention will be described and become more apparent from the detailed description of exemplary embodiments when read in conjunction with accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
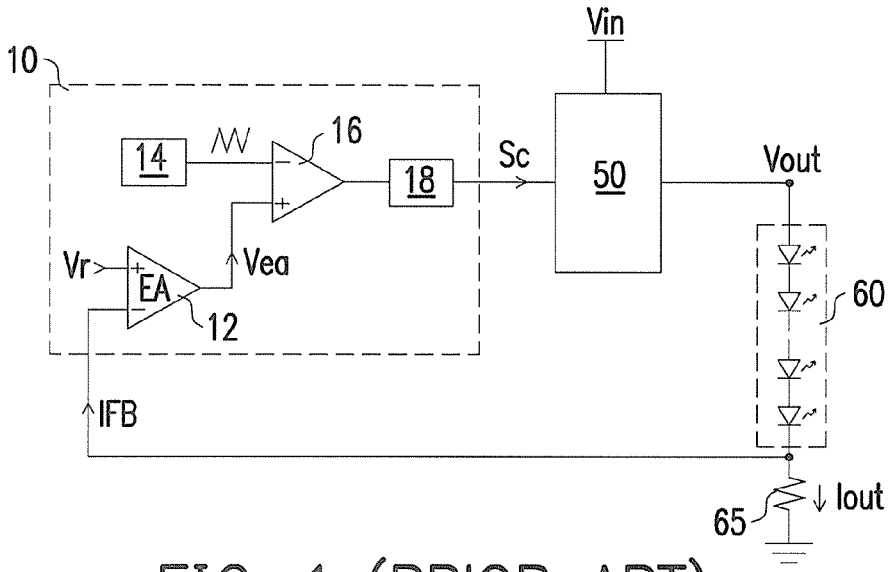
FIG. 1 (PRIOR ART)
FIG. 1 is a diagram of a conventional light emitting diode (LED) driving circuit.
Figure 2:
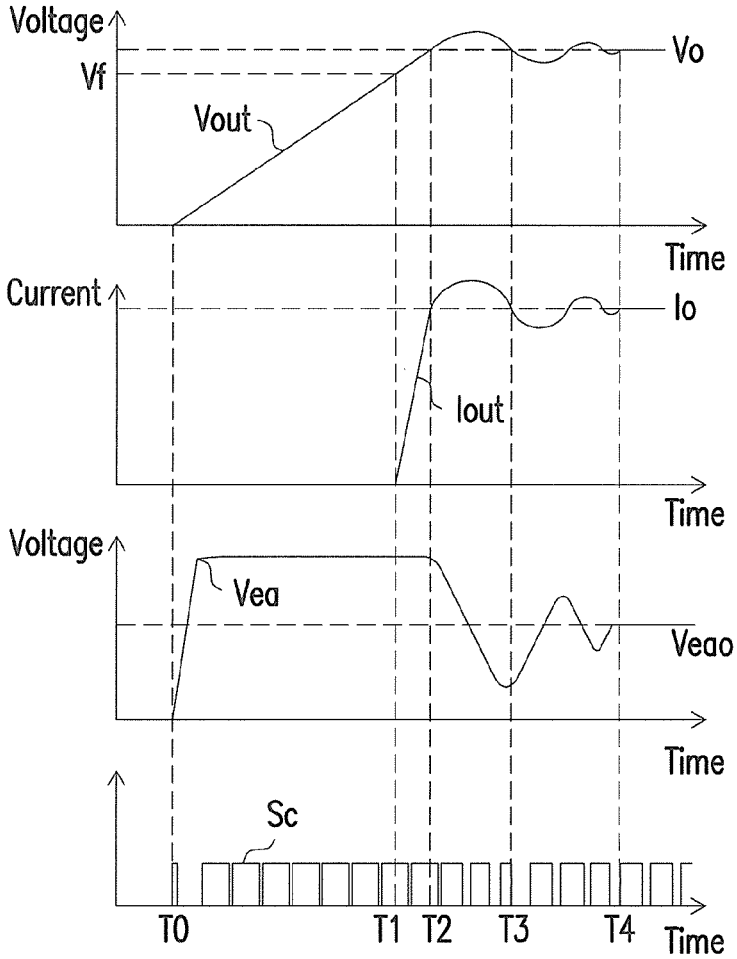
FIG. 2 (PRIOR ART)
FIG. 2 illustrates waveforms of signals in the LED driving circuit in FIG. 1 during a startup process of the LED driving circuit.

Reference will now be made in detail to the present preferred embodiments of the invention, examples of which are illustrated in the accompanying drawings. Wherever possible, the same reference numbers are used in the drawings and the description to refer to the same or like parts.

Figure 3:
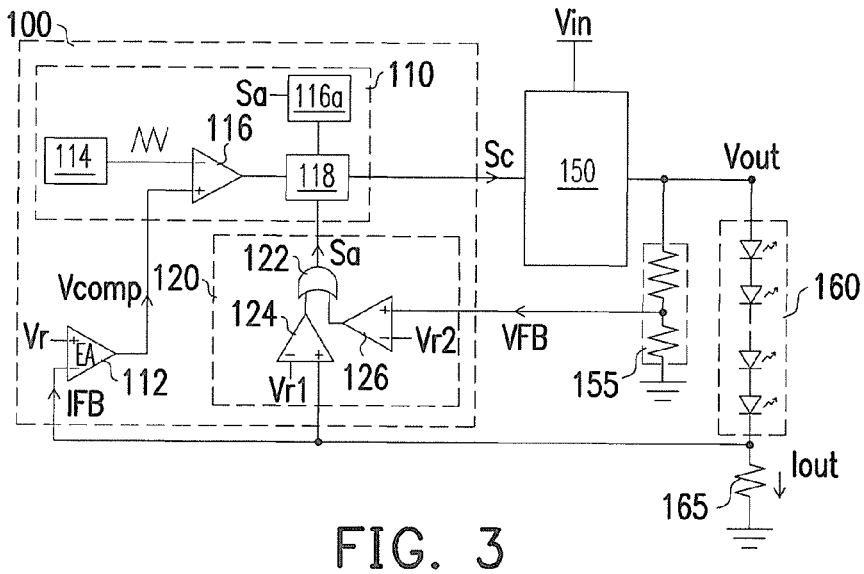
FIG. 3 is a diagram of a non-linear load driving circuit according to a first exemplary embodiment of the invention.

FIG. 3 is a diagram of a non-linear load driving circuit according to a first exemplary embodiment of the invention. The non-linear load driving circuit includes a controller 100 and a conversion circuit 150. The non-linear load driving circuit drives a non-linear load 160. In the present embodiment, the non-linear load 160 is described as a light emitting diode (LED) module. The conversion circuit 150 is a switching conversion circuit, and which includes at least one switch (not shown) and is coupled to an input voltage source Vin. The switch receives a control signal Sc generated by the controller 100 to control the amount of power transmitted from the input voltage source Vin to the conversion circuit 150. The conversion circuit 150 converts the power and provides a load current Iout and a load voltage Vout to drive the non-linear load 160.

The controller 100 includes a feedback unit 112, a pulse width control unit 110, and an overshoot reduction unit 120. The feedback unit 112 may be an error amplifier or a feedback circuit with integral function. The feedback unit 112 generates a feedback signal Vcomp according to a current feedback signal IFB (generated by a current detection circuit 165) and a reference voltage Vr, wherein the current feedback signal IFB represents the load current Iout flowing through the non-linear load 160. The overshoot reduction unit 120 includes an OR gate 122, a first comparator 124 and a second comparator 126. The first comparator 124 receives the current feedback signal IFB and a first reference signal Vr1 and generates a high level signal when the current feedback signal IFB is higher than the first reference signal Vr1. The second comparator 126 receives a voltage feedback signal VFB (generated by a voltage detection circuit 155) representing the output voltage Vout and a second reference signal Vr2 and generates a high level signal when the voltage feedback signal VFB is higher than the second reference signal Vr2. The OR gate 122 is coupled to the first comparator 124 and the second comparator 126 and outputs an overshoot reduction signal Sa. The pulse width control unit 110 includes an oscillator 114, a pulse width modulation (PWM) comparator 116, a pulse width limiter 116*a*, and a driving circuit 118. The oscillator 114 generates a triangular wave signal and sends the triangular wave signal to the inverting input terminal of the PWM comparator 116, and the PWM comparator 116 receives the feedback signal Vcomp through its non-inverting input terminal and generates a PWM signal for the driving circuit 118 according to the comparison of the feedback signal Vcomp and the triangle wave signal. The pulse width limiter 116*a* is coupled to the overshoot reduction unit 120 to receive the overshoot reduction signal Sa generated by the overshoot reduction unit 120. When the pulse width limiter 116*a* receives the overshoot reduction signal Sa, it generates a limit control signal having a predetermined duty cycle (i.e., having a fixed pulse width) for the driving circuit 118. The driving circuit 118 is coupled to the PWM comparator 116, the pulse width limiter 116*a*, and the overshoot reduction unit 120. The driving circuit 118 outputs a control signal Sc according to the PWM signal when the overshoot reduction signal Sa is not generated and outputs the control signal according to one of the PWM signal and the limit control signal which has a smaller duty cycle after the overshoot reduction signal Sa is generated.

Figure 4:
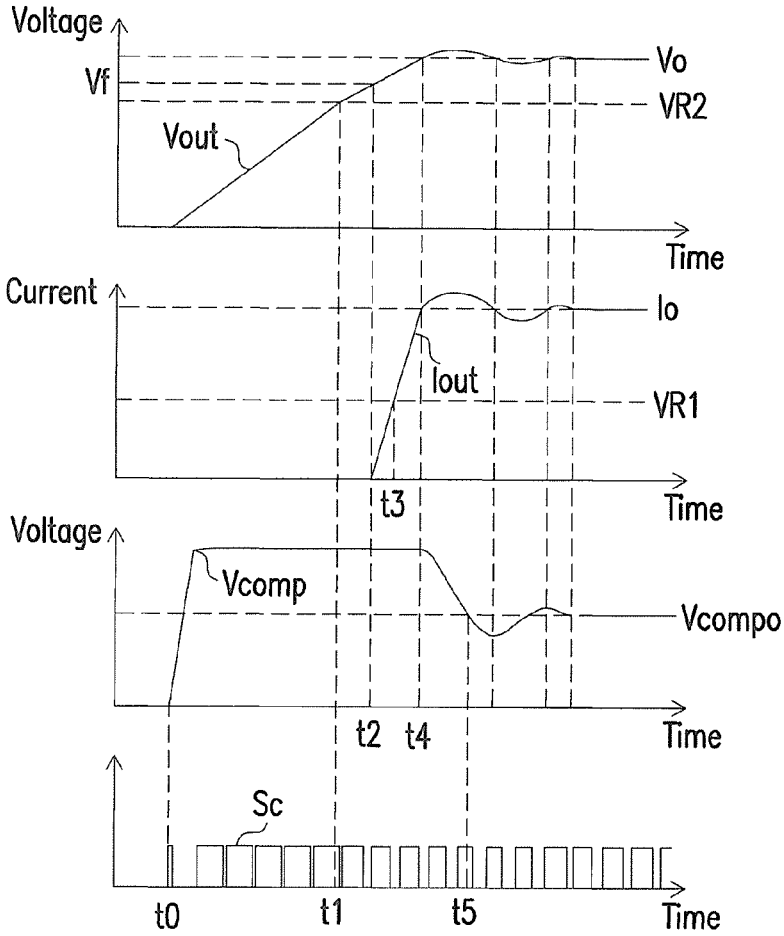
FIG. 4 illustrates waveforms of signals in the non-linear load driving circuit in FIG. 3.

FIG. 4 illustrates waveforms of signals in the non-linear load driving circuit in FIG. 3. Before the controller 100 is started, the output voltage Vout, the output current Iout, the feedback signal Vcomp, and the control signal Sc are all at low levels. When the controller 100 is started at time point t0, because the output current Tout is much lower than the predetermined output current Io, the feedback signal Vcomp quickly increases and accordingly the duty cycle of the control signal Sc also quickly increases. At time point t1, the voltage feedback signal VFB changes from being smaller than the second reference signal Vr2 to being greater than the second reference signal Vr2. In this case, the output voltage Vout reaches a predetermined voltage VR2, and the second comparator 126 outputs a high level signal, so that the OR gate 122 outputs the overshoot reduction signal Sa. The pulse width limiter 116*a* receives the overshoot reduction signal Sa and accordingly outputs a limit control signal with a fixed pulse width. Herein because the feedback signal Vcomp remains at its highest level, the duty cycle of the PWM signal output by the PWM comparator 116 is greater than the duty cycle of the limit control signal, and so the driving circuit 118 outputs the control signal Sc according to the limit control signal. Accordingly, the duty cycle of the control signal Sc decreases after the time point t1. At time point t2, the output voltage Vout increases to the threshold voltage Vf of the non-linear load 160, and a current starts to flow through the non-linear load 160, so that the output current Tout starts to increase. At time point t3, the current feedback signal IFB is equal to the first reference signal Vr1. In this case, the output current Tout reaches a predetermined current VR1, and the first comparator 124 outputs a high level signal, wherein the predetermined current VR1 is smaller than the predetermined output current Io. At time point t4, the output current Tout increases to the predetermined output current Io and the feedback signal Vcomp starts to decrease. At time point t5, the feedback signal Vcomp decreases to a feedback steady value Vcompo.

Between time points t4-t5, the duty cycle of the PWM signal output by the PWM comparator 116 gradually decreases along with the decrease of the feedback signal Vcomp, and when the duty cycle of the PWM signal is smaller than the duty cycle of the limit control signal, the driving circuit 118 starts to output the control signal Sc according to the PWM signal. Compared with the conventional technique, in the invention, the duty cycle of the control signal Sc is always smaller from the time point t4 to when the duty cycle of the PWM signal becomes smaller than the duty cycle of the limit control signal, so that the increase slopes of both the output current Iout and the output voltage Vout are very small. Thereby, the extent of overshoot is reduced.

The settings of the first reference signal Vr1 (corresponding to the predetermined current VR1) and the second reference signal Vr2 (corresponding to the predetermined voltage VR2) can be adjusted or skipped/omitted according to the actual circuit design. For example, the first comparator 124 or the second comparator 126 may be skipped/omitted so that the controller 100 determines whether to reduce the duty cycle of the control signal only according to whether the output voltage Vout or the output current Tout reaches a predetermined value. In addition, when the first comparator 124 and the second comparator 126 are both disposed, the time point for the output voltage Vout to reach the predetermined voltage VR2 may not be earlier than that for the output voltage Vout to reach the predetermined current VR1, and the predetermined voltage VR2 may be higher or lower than the threshold voltage Vf according to the actual application. The problem of insufficient response time with a single determination can be avoided by disposing both the first comparator and the second comparator. For example, if the load is an LED, when only the first comparator 124 is disposed, the time for the output current Iout to increase from the predetermined current VR1 to the predetermined output current Io may be very short and the controller 100 may not have the time to reduce the duty cycle of the control signal Sc. Thus, by disposing the second comparator 126, the controller 100 can also determine whether to reduce the duty cycle of the control signal Sc according to the output voltage Vout, so that the controller 100 can reduce the duty cycle of the control signal Sc when any one of the conditions is met. Thereby, the possibility of the controller 100 not being able to respond in time is reduced.

Figure 5:
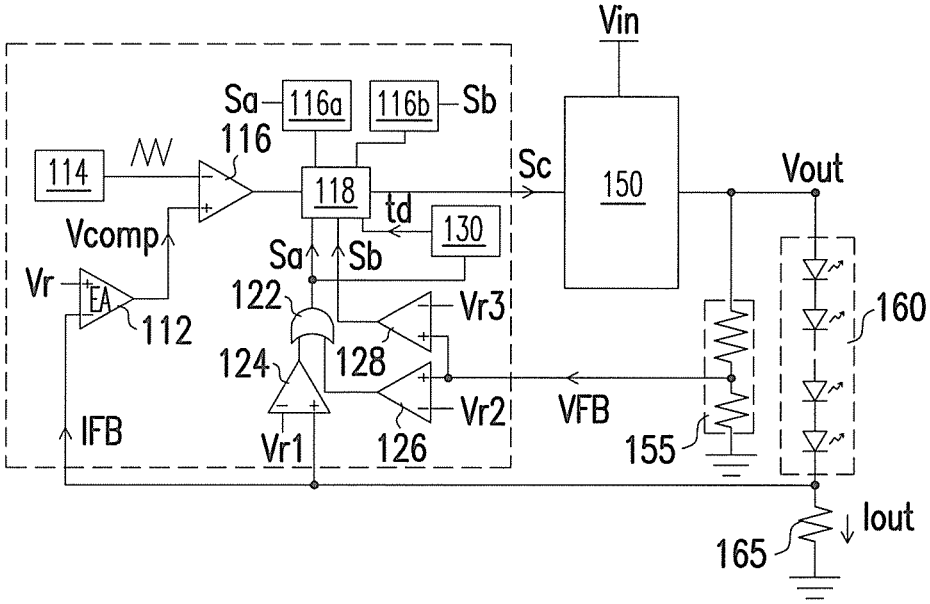
FIG. 5 is a diagram of a non-linear load driving circuit according to a second exemplary embodiment of the invention.

FIG. 5 is a diagram of a non-linear load driving circuit according to a second exemplary embodiment of the invention. Compared to the embodiment illustrated in FIG. 3, a third comparator 128 and a pulse width limiter 116*b* are further disposed in the present embodiment. The third comparator 128 receives the voltage feedback signal VFB and a third reference signal Vr3 and generates a high level signal for the driving circuit 118 and the pulse width limiter 116*b* when the voltage feedback signal VFB is higher than the third reference signal Vr3. The output voltage Vout corresponding to the third reference signal Vr3 is lower than the predetermined voltage VR2 corresponding to the second reference signal Vr2 and the threshold voltage Vf. Accordingly, the time point for generating an overshoot reduction signal Sb is earlier than that for generating the overshoot reduction signal Sa. The pulse width limiter 116*b* receives the overshoot reduction signal Sb and generates a limit control signal with a predetermined duty cycle (i.e., a fixed pulse width) for the driving circuit 118, wherein the duty cycle of the limit control signal generated by the pulse width limiter 116*b* is greater than the duty cycle of the limit control signal generated by the pulse width limiter 116*a*. The driving circuit 118 outputs the control signal according to the PWM signal when the overshoot reduction signal Sb is not generated, outputs the control signal according to one of the PWM signal and the limit control signal generated by the pulse width limiter 116*b* which has a smaller duty cycle after the overshoot reduction signal Sb is generated but before the overshoot reduction signal Sa is generated, and outputs the control signal according to one of the PWM signal and the limit control signal generated by the pulse width limiter 116*a* which has a smaller duty cycle after the overshoot reduction signal Sa is generated.

Accordingly, the controller can gradually reduce the duty cycle of the control signal Sc, so that the possibility of the controller not being able to reduce the duty cycle in time can be further reduced.

Additionally, the controller may further include a delay unit 130. The delay unit 130 receives the overshoot reduction signal Sa and generates a delay stop signal td for the driving circuit 118 after a predetermined time period from the time point of receiving the overshoot reduction signal Sa. After the driving circuit 118 receives the delay stop signal td, it stops determining the duty cycle of the control signal Sc according to the limit control signals Sa, Sb, respectively generated by the pulse width limiters 116*a* and 116*b*. Thus, the driving circuit 118 continues to adjust the duty cycle of the control signal Sc according to the PWM signal of the PWM comparator 116, so as to prevent reduction of the transient response capability from being affected by limiting the duty cycle of the control signal Sc.

Figure 6:
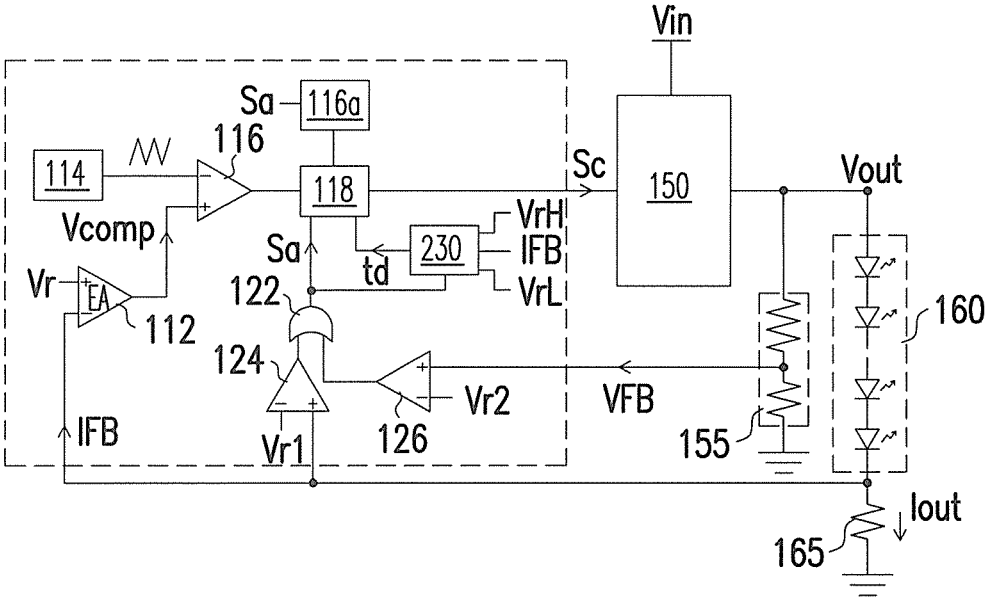
FIG. 6 is a diagram of a non-linear load driving circuit according to a third exemplary embodiment of the invention.

FIG. 6 is a diagram of a non-linear load driving circuit according to a third exemplary embodiment of the invention. Compared to the embodiment illustrated in FIG. 3, a delay unit 230 is further disposed in the present embodiment. The delay unit 230 receives the current feedback signal IFB, a current upper limit reference signal VrH, and a current lower limit reference signal VrL, wherein the current upper limit reference signal VrH is higher than the reference voltage Vr, and the current lower limit reference signal VrL is lower than the reference voltage Vr. After the delay unit 230 receives the overshoot reduction signal Sa, it compares the current feedback signal IFB, the current upper limit reference signal VrH, and the current lower limit reference signal VrL. When the current feedback signal IFB remains between the current upper limit reference signal VrH and the current lower limit reference signal VrL for a predetermined time period, the delay unit 230 generates a delay stop signal td for the driving circuit 118 to stop reducing the duty cycle of the control signal Sc according to the overshoot reduction signal Sa. By using the delay unit 230, it can be determined to reduce the duty cycle of the control signal Sc when the amplitude of the output current Iout is too large (i.e., large overshoot) and to stop controlling the duty cycle of the control signal Sc when the overshoot is within an acceptable range, so that an optimal transient response capability can be obtained.

Foregoing embodiments are described by assuming that the current variation slope is greater than the voltage variation slope when the non-linear load 160 is in operation. If the voltage variation slope is greater than the current variation slope when the non-linear load 160 is in operation, the delay unit 230 in the present embodiment can determine the time for reducing overshoot according to the voltage feedback signal VFB instead of the current feedback signal IFB.

Figure 7:
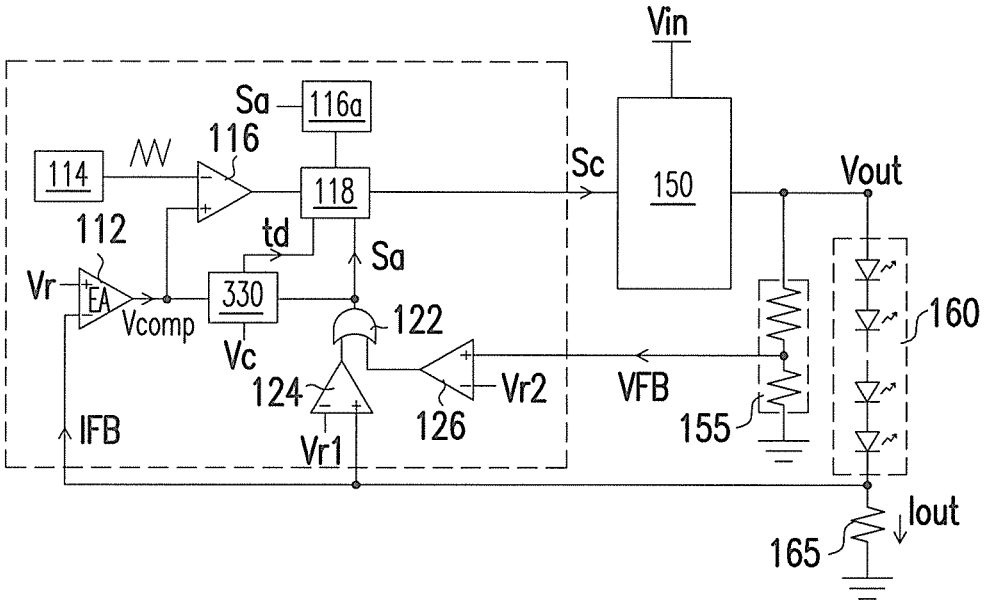
FIG. 7 is a diagram of a non-linear load driving circuit according to a fourth exemplary embodiment of the invention.

FIG. 7 is a diagram of a non-linear load driving circuit according to a fourth exemplary embodiment of the invention. Compared to that in the embodiment illustrated in FIG. 6, the delay unit 330 in the present embodiment determines the time point for stopping reducing the duty cycle of the control signal Sc by detecting the feedback signal Vcomp. After receiving the overshoot reduction signal Sa, the delay unit 330 compares the feedback signal Vcomp with a reference signal Vc, and when the feedback signal Vcomp decreases to be lower than the reference signal Vc, the delay unit 330 generates a delay stop signal td for the driving circuit 118. Thus, the same overshoot reduction effect can be achieved. Alternatively, the delay unit 330 may also output the delay stop signal td after it determines that the feedback signal Vcomp has been lower than the reference signal Vc for a predetermined time period. Therefore, not only the overshoot is reduced, but the output power of the conversion circuit 150 is limited when the feedback signal Vcomp remains high resulted from that overload is produced in the non-linear load 160 due to short circuit or some other reasons.

Figure 8:
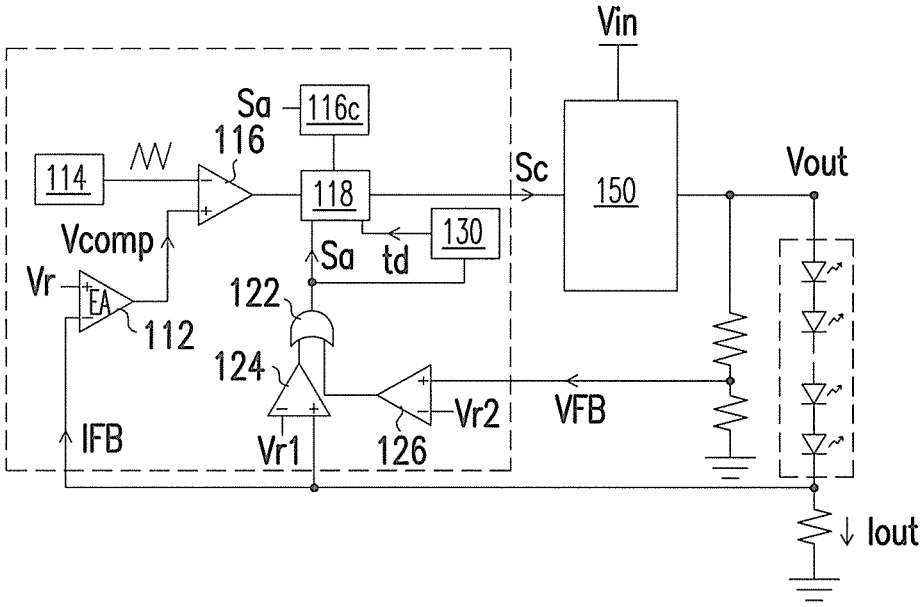
FIG. 8 is a diagram of a non-linear load driving circuit according to a fifth exemplary embodiment of the invention.

FIG. 8 is a diagram of a non-linear load driving circuit according to a fifth exemplary embodiment of the invention. Compared to the embodiment illustrated in FIG. 3, a delay unit 130 is further disposed in the present embodiment to limit the time period of the process for reducing the duty cycle of the control signal Sc, so as to achieve an optimal transient response capability. In addition, because the duty cycle of the limit control signal output by the pulse width limiter 116*c* is generated in a gradually decreasing manner (which is different from the output of the pulse width limiter 116*a*, the control signal has a fixed duty cycle), and so the duty cycle of the control signal Sc is also reduced in a gradually decreasing manner.

Figure 9:
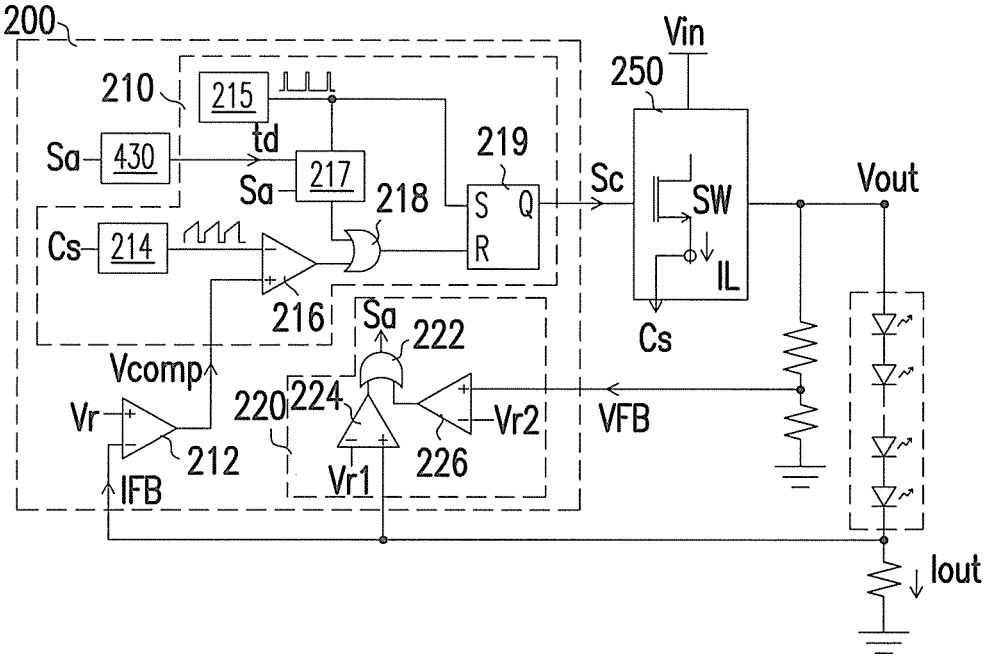
FIG. 9 is a diagram of a non-linear load driving circuit according to a sixth exemplary embodiment of the invention.

FIG. 9 is a diagram of a non-linear load driving circuit according to a sixth exemplary embodiment of the invention. In the present embodiment, the non-linear load driving circuit includes a controller 200 and a conversion circuit 250. The non-linear load driving circuit drives a non-linear load. The controller 200 is a current-mode controller, which is different from the voltage-mode controller in foregoing embodiments.

The controller 200 includes a feedback unit 212, a pulse width control unit 210, an overshoot reduction unit 220, and a delay unit 430. The feedback unit 212 may be an error amplifier or a feedback circuit having an integral function. The feedback unit 212 generates the feedback signal Vcomp according to the current feedback signal IFB and the reference voltage Vr, wherein the current feedback signal IFB represents the load current Iout flowing through the non-linear load. The overshoot reduction unit 220 includes an OR gate 222, a first comparator 224, and a second comparator 226. The first comparator 224 receives the current feedback signal IFB and the first reference signal Vr1 and generates a high level signal when the current feedback signal IFB is higher than the first reference signal Vr1. The second comparator 226 receives the voltage feedback signal VFB representing the output voltage Vout and the second reference signal Vr2 and generates a high level signal when the voltage feedback signal VFB is higher than the second reference signal Vr2. The OR gate 222 is coupled to the first comparator 224 and the second comparator 226 and outputs the overshoot reduction signal Sa in response to outputs of both the first comparator 224 and the second comparator 226.

The pulse width control unit 210 includes a slope compensator 214, a pulse generator 215, a PWM comparator 216, a pulse width limiter 217, an OR gate 218, and an SR flip-flop 219. The slope compensator 214 generates a slope compensation signal for the inverting input terminal of the PWM comparator 216 according to a current sensing signal Cs, wherein the current sensing signal Cs represents a current IL flowing through a switch SW of the conversion circuit 250. The PWM comparator 216 also receives the feedback signal Vcomp through its non-inverting input terminal and generates a PWM signal for the OR gate 218 according to the comparison of the feedback signal Vcomp and the slope compensation signal. The pulse generator 215 generates a pulse signal with a fixed frequency and sends the pulse signal to the set terminal S of the SR flip-flop 219. Accordingly, the control signal Sc output by the SR flip-flop 219 through its output terminal Q turns to a high level to turn on the switch SW of the conversion circuit 250 for transmitting power from the input voltage source Vin. The OR gate 218 outputs a signal to the reset terminal R of the SR flip-flop 219. Meanwhile, the control signal Sc output by the SR flip-flop 219 through its output terminal Q turns to a low level to turn off the switch SW of the conversion circuit 250 for stopping transmitting the power from the input voltage source Vin.

When the current feedback signal IFB changes from being smaller than to being greater than the first reference signal Vr1, the first comparator 224 generates a high level signal. Alternatively, when the voltage feedback signal VFB changes from being smaller than to being greater than the second reference signal Vr2, the second comparator 226 generates a high level signal, and accordingly the OR gate 222 generates the overshoot reduction signal Sa. When the pulse width limiter 217 receives the overshoot reduction signal Sa, it performs a phase shift on the overshoot reduction signal Sa according to the pulse signal of the pulse generator 215, so as to maintain a fixed phase difference between the pulse signals generated by the pulse width limiter 217 and the pulse signal of the pulse generator 215. The OR gate 218 then performs an OR logic calculation in response to the outputs of the pulse width limiter 217 and the PWM comparator 216, so as to reduce/control the duty cycle of the control signal Sc. The delay unit 430 starts counting after it receives the overshoot reduction signal Sa and generates a delay stop signal td for the pulse width limiter 217 after a predetermined time period, so as to stop reducing the duty cycle of the control signal Sc according to the overshoot reduction signal Sa.

In summary, when the initial state of the voltage or current on a non-linear load is very different from the predetermined steady value, overshoot will be produced in the voltage or current during a feedback control process (for example, when a controller is just started or a dimming control is performed). In the invention, the voltage or current on the non-linear load is detected, and the duty cycle of the control signal of the controller is reduced before the voltage or current reaches the predetermined steady value, so as to slow down the transmission of power from an input voltage source. Thereby, the overshoot can be reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A controller, for controlling a conversion circuit to drive a non-linear load, the controller comprising:

a feedback unit, for generating a feedback signal according to a current feedback signal, wherein the current feedback signal represents a load current flowing through the non-linear load;

a pulse width control unit, for generating a control signal according to the feedback signal to control a power output of the conversion circuit; and an overshoot reduction unit, for determining whether the load current changes from being smaller than a predetermined value to being greater than the predetermined value according to the current feedback signal and generating an overshoot reduction signal when the load current changes from being smaller than the predetermined value to being greater than the predetermined value;

wherein the pulse width control unit receives the overshoot reduction signal and reduces a duty cycle of the control signal according to the overshoot reduction signal.

2. The controller according to claim 1 further comprising a delay unit coupled to the overshoot reduction unit, and is adapted to generate a delay stop signal to make the pulse width control unit to stop reducing the duty cycle of the control signal according to the overshoot reduction signal.

3. The controller according to claim 2, wherein the delay unit determines whether to generate the delay stop signal according to a predetermined time period, the load current, or the feedback signal after receiving the overshoot reduction signal.

4. The controller according to claim 1, wherein the overshoot reduction unit generates a limit signal when a load voltage applied to the non-linear load changes from being smaller than a predetermined voltage to being greater than the predetermined voltage, so as to make the pulse width control unit to stabilize the duty cycle of the control signal at a predetermined duty cycle.

5. A controller, for controlling a conversion circuit to drive a non-linear load, the controller comprising:

a feedback unit, for generating a feedback signal according to a current feedback signal, wherein the current feedback signal represents a load current flowing through the non-linear load;

a pulse width control unit, for generating a control signal according to the feedback signal to control a power output of the conversion circuit; and an overshoot reduction unit, for generating an overshoot reduction signal according to a voltage feedback signal, wherein the voltage feedback signal represents a load voltage applied to the non-linear load;

wherein the pulse width control unit receives the overshoot reduction signal and reduces a duty cycle of the control signal according to the overshoot reduction signal.

6. The controller according to claim 5 further comprising a delay unit coupled to the overshoot reduction unit, wherein the delay unit is adapted to generate a delay stop signal to make the pulse width control unit to stop reducing the duty cycle of the control signal according to the overshoot reduction signal.

7. The controller according to claim 6, wherein the delay unit determines whether to generate the delay stop signal according to a predetermined time period, the load current, or the feedback signal after receiving the overshoot reduction signal.

8. The controller according to claim 5, wherein the overshoot reduction unit generates a limit signal when a load voltage applied to the non-linear load changes from being smaller than a first predetermined voltage to being greater than the first predetermined voltage, so as to make the pulse width control unit to stabilize the duty cycle of the control signal at a predetermined duty cycle.

9. The controller according to claim 5, wherein the overshoot reduction unit further determines whether to generate the overshoot reduction signal according to the current feedback signal and generates the overshoot reduction signal when the load current changes from being smaller than a predetermined current to being greater than the predetermined current or the load voltage changes from being smaller than a second predetermined voltage to being greater than the second predetermined voltage.

10. A non-linear load driving circuit, for driving a non-linear load, the non-linear load driving circuit comprising:

a conversion circuit, for coupling an input voltage source and the non-linear load and converting a power received from the input voltage source to drive the non-linear load at a predetermined output current; and a controller, for generating at least one control signal according to a current feedback signal to control the conversion circuit to convert the power, wherein the current feedback signal represents a load current flowing through the non-linear load;

wherein the controller reduces a duty cycle of the control signal when the load current flowing through the non-linear load changes from being smaller than a predetermined current to being greater than the predetermined current or a load voltage applied to the non-linear load changes from being smaller than a predetermined voltage to being greater than the predetermined voltage, and the predetermined current is smaller than the predetermined output current.

11. The non-linear load driving circuit according to claim 10, wherein the non-linear load is a light emitting diode (LED) module.

12. The non-linear load driving circuit according to claim 10, wherein the controller determines whether to stop reducing the duty cycle of the control signal according to a predetermined time period or the load current.

* * * * *